US011559871B2

(12) United States Patent
Chen et al.

(10) Patent No.: US 11,559,871 B2
(45) Date of Patent: Jan. 24, 2023

(54) DEVICE FOR INTEGRALLY PROCESSING HOUSING OF 3C PRODUCT

(71) Applicant: Dongguan University Of Technology, Guangdong (CN)

(72) Inventors: Shenggui Chen, Guangdong (CN); Yongbo Huang, Guangdong (CN); Wentao Zhang, Guangdong (CN); Zhaoyang Lin, Guangdong (CN); Zhenzhong Sun, Guangdong (CN); Bingheng Lu, Guangdong (CN)

(73) Assignee: Dongguan University Of Technology

( * ) Notice: Subject to any disclaimer, the term of this patent is extended or adjusted under 35 U.S.C. 154(b) by 302 days.

(21) Appl. No.: 16/910,902

(22) Filed: Jun. 24, 2020

(65) Prior Publication Data

US 2020/0406421 A1 Dec. 31, 2020

(30) Foreign Application Priority Data

Jun. 26, 2019 (CN) ..... 201910559147.7

(51) Int. Cl.
*B24B 41/00* (2006.01)
*B24B 41/06* (2012.01)

(52) U.S. Cl.
CPC ..... *B24B 41/005* (2013.01); *B24B 41/068* (2013.01)

(58) Field of Classification Search
CPC ..... B24B 9/00; B24B 9/002; B24B 9/005; B24B 9/06; B24B 9/065; B24B 9/08;
(Continued)

(56) References Cited

U.S. PATENT DOCUMENTS 1,918,668 A * 7/1933 Reusser ..... B24B 9/08 82/170
4,375,738 A * 3/1983 Bando ..... B24B 9/10 451/4

(Continued)

FOREIGN PATENT DOCUMENTS

CN 201922325 U 8/2011
CN 103606592 A 2/2014

(Continued)

OTHER PUBLICATIONS

CN-105328538-A Machine Translation (Year: 2016).*
Chinese Search Report for Application No. 201910559147.7 dated Mar. 19, 2020, 2 pages.

*Primary Examiner* — Lee D Wilson
*Assistant Examiner* — Alberto Saenz
(74) *Attorney, Agent, or Firm* — Lerner, David, Littenberg, Krumholz & Mentlik, LLP

(57) ABSTRACT

The invention relates to a device for integrally processing a housing of a Computing, Communication, and Consumer (3C) product. The device includes a loading frame and an upper frame, where a material receiving device is arranged in the loading frame, a width of the loading frame is greater than that of the housing, a grinding device is arranged below the upper frame, and the grinding device includes a grinding movement device; the grinding movement device is connected to a grinding installation block, an outer side of the grinding installation block is provided with grinding lifting balls, a grinding arc block is embedded in an inner side of an upper portion of the grinding installation block, and the upper frame is provided with a material pressing device. An outer side of the loading frame is provided with a feeding and discharging device.

10 Claims, 5 Drawing Sheets

(58) Field of Classification Search
CPC .. B24B 9/085; B24B 9/10; B24B 9/14; B24B 9/20; B24B 9/142; B24B 9/146; B24B 19/00; B24B 19/009; B24B 41/005; B24B 41/068; B24B 41/04; B24B 41/06; B24B 47/22
USPC ..... 451/43, 65
See application file for complete search history.

(56) References Cited

U.S. PATENT DOCUMENTS

| | | | | |
|---|---|---|---|---|
| 6,478,663 | B1 | 11/2002 | Ganser | |
| 8,690,460 | B2 * | 4/2014 | Kuehl | G03B 17/48 396/428 |
| 2019/0389024 | A1 | 12/2019 | Li | |

FOREIGN PATENT DOCUMENTS

| | | | | |
|---|---|---|---|---|
| CN | 204397544 | U | | 6/2015 |
| CN | 105328538 | A | * | 2/2016 |
| CN | 105328538 | A | | 2/2016 |
| CN | 106560286 | A | | 4/2017 |
| CN | 108772701 | A | | 11/2018 |
| CN | 208929845 | U | | 6/2019 |
| WO | 0006339 | A1 | | 2/2000 |

* cited by examiner

DEVICE FOR INTEGRALLY PROCESSING HOUSING OF 3C PRODUCT

CROSS REFERENCE TO RELATED APPLICATIONS

This application claims priority from Chinese application number 201910559147.7, filed Jun. 26, 2019, the disclosure of which is hereby incorporated herein by reference.

TECHNICAL FIELD

The present invention relates to the field of Computing, Communication, and Consumer (3C) product processing devices, and in particular, to a device for integrally processing a housing of a 3C product.

BACKGROUND

The 3C products mean the combination of Computer, Communication and Consumer electronics. They are also called information appliances. Mobile phones are common 3C products, and housings thereof are mostly made of metal materials and formed by casting. One of the housings is shown in FIG. 2. An upper portion is a top view and a lower portion is a sectional view. It can be seen from the figure that both sides are arc-shaped. Therefore, the arc needs to be polished during processing. Most of the existing polishing is conducted manually. When the arc-shaped surface is mechanically polished, the arc-shaped surface needs positioning and clamping. However, most of clamping and positioning operations of existing carriers need manual feeding and adjustment, which is inefficient.

SUMMARY

The present invention provides a device for integrally processing a housing of a 3C product. Through the matching design of a loading structure, a grinding device and a feeding and discharging device, feeding, positioning, grinding and discharging of the housing can be integrated, and the processing efficiency is improved.

In order to implement the foregoing objectives, the present invention adopts the following technical solution: a device for integrally processing a housing of a 3C product, where the device includes a loading frame and an upper frame, a material receiving device capable of sucking an inner bottom surface of a housing is arranged in the loading frame, a width of the loading frame is greater than that of the housing, a grinding device is arranged below the upper frame, and the grinding device includes a grinding movement device capable of lifting and moving back and forth and arranged below the upper frame; the grinding movement device is connected to a grinding installation block, an outer side of the grinding installation block is provided with grinding lifting balls tangentially matched with an inner wall of one side of the loading frame, a grinding arc block having an identical arc shape of a polished housing is embedded in an inner side of an upper portion of the grinding installation block, a distance between an inner side of a lower portion of the grinding installation block and the other side of the loading frame is equal to a width of the housing, a lower end of the grinding installation block is an inclined plane inclined outwards and downwards, and the upper frame is also provided with a material pressing device matched with the housing. An outer side of the loading frame is provided with a feeding and discharging device, the feeding and discharging device includes a lower frame, a feeding and discharging lifting cylinder is arranged on the lower frame, a discharging barrel and a feeding barrel which are stacked are arranged above the feeding and discharging lifting cylinder, and feeding and discharging picking/placing devices are arranged in the discharging barrel and the feeding barrel.

Preferably, the feeding and discharging picking/placing device includes a feeding and discharging picking/placing movable cylinder which is arranged below the feeding barrel or an upper plate of the discharging barrel, and the feeding and discharging picking/placing movable cylinder is connected to a feeding and discharging picking/placing frame; a feeding and discharging picking/placing lifting cylinder, a feeding and discharging picking/placing spring and an unloading ejector rob are arranged in the feeding and discharging picking/placing frame, a feeding and discharging picking/placing lifting block is connected below the feeding and discharging picking/placing lifting cylinder, connected to the feeding and discharging picking/placing spring and penetrated by the unloading ejector rob, and a feeding and discharging picking/placing suction cup is arranged below the feeding and discharging picking/placing lifting block.

Preferably, a feeding and discharging lifting limiting device is arranged between the lower frame and the discharging barrel and includes an inversely T-shaped feeding and discharging limiting movable block arranged below the discharging barrel and a feeding and discharging limiting column arranged on the lower frame in a vertical direction, the feeding and discharging limiting column is provided with a lower limiting plate and an upper limiting plate, and when the feeding and discharging limiting movable block is blocked and limited by the lower limiting plate and the upper limiting plate, the discharging barrel or the feeding barrel is butted with the loading frame.

Preferably, a plate-shaped structure is arranged on an outer side of the upper portion of the grinding installation block and located above the loading frame, and a contact sensor matched with the loading frame is arranged below the plate-shaped structure.

Preferably, the upper frame is provided with a rotating motor, the rotating motor is matched with a turntable below the upper frame, the rotating center of the turntable coincides with the center of the loading frame, and the grinding device and the material pressing device are arranged below the turntable, with a phase difference of 180°.

Preferably, the grinding movement device includes a grinding installation barrel arranged below the turntable, a grinding lifting cylinder is arranged in the grinding installation barrel, a grinding lifting block is connected below the grinding lifting cylinder and provided with a grinding lifting guide block tangentially matched with the grinding installation barrel, a grinding movable motor and a grinding movable screw rod which are mutually matched are arranged below the grinding lifting block, the grinding movable screw rod is sleeved and matched with the grinding movable block, and the grinding installation block is arranged below the grinding movable block.

Preferably, there are two grinding lifting guide blocks, a difference between heights of the two grinding lifting guide blocks is equal to a thickness of the turntable, the higher grinding lifting guide block is positioned outside the turntable, and upper ends of the two grinding lifting guide blocks are both provided with pressure sensors.

Preferably, the material receiving device includes a material receiving lifting cylinder arranged in the loading frame, a material receiving block matched with a lower surface of the housing is connected above the material receiving lifting cylinder, the material receiving block includes a material receiving frame with an upper opening, a sealing ring capable of being matched with the lower surface of the housing is arranged in the material receiving frame, a material receiving supporting column flush with an upper end of the material receiving frame is also arranged in the material receiving frame, and a material receiving air pump is communicated below the material receiving frame.

Preferably, waste material collecting frames are arranged on both sides inside the loading frame, and the waste material collecting frames can support a part of the housing being in a grinding process.

Preferably, the material pressing device includes a material pressing lifting cylinder arranged below the upper frame, a material pressing block is arranged below the material pressing lifting cylinder, a material pressing hole is formed in a lower portion of the material pressing block, a material pressing spring in a vertical direction is arranged in the material pressing hole, a material pressing movable block is connected below the material pressing spring, and material pressing balls are embedded below the material pressing movable block.

The text annotations shown in the figure are as follows: 1. loading frame; 2. material receiving device; 3. waste material collection frame; 4. housing; 5. grinding device; 6. material pressing device; 7. upper frame; 8. rotating motor; 9. turntable; 10. feeding and discharging device; 11. material receiving lifting cylinder; 12. material receiving block; 13. material receiving frame; 14. sealing ring; 15. material receiving air pump; 16. material receiving supporting column; 21. grinding installation barrel; 22. grinding lifting cylinder; 23. grinding lifting block; 24. grinding lifting guide block; 25. pressure sensor; 26. grinding movable screw rod; 27. grinding movable block; 28. grinding installation block; 29. grinding arc block; 30. grinding lifting ball; 31. contact sensor; 33. material pressing lifting cylinder; 34. material pressing block; 35. material pressing spring; 36. material pressing movable block; 37. material pressing ball; 41. lower frame; 42. discharging barrel; 43. feeding barrel; 44. feeding and discharging lifting cylinder; 45. feeding and discharging picking/placing device; 46. feeding and discharging lifting limiting device; 47. feeding and discharging picking/placing movable cylinder; 48. feeding and discharging picking/placing frame; 49. feeding and discharging picking/placing lifting cylinder; 50. feeding and discharging picking/placing lifting block; 51. feeding and discharging picking/placing spring; 52. feeding and discharging picking/placing suction cup; 53. unloading ejector rob; 55. feeding and discharging limiting movable block; 56. feeding and discharging limiting column; 57. lower limiting plate; 58. upper limiting plate.

DETAILED DESCRIPTION

In order to enable those skilled in the art to better understand the technical solution of the present invention, the present invention will be described in detail below with reference to accompanying drawings. The description in this section is merely exemplary and explanatory and should not have any limitation on the protection scope of the present invention.

Figure 1:
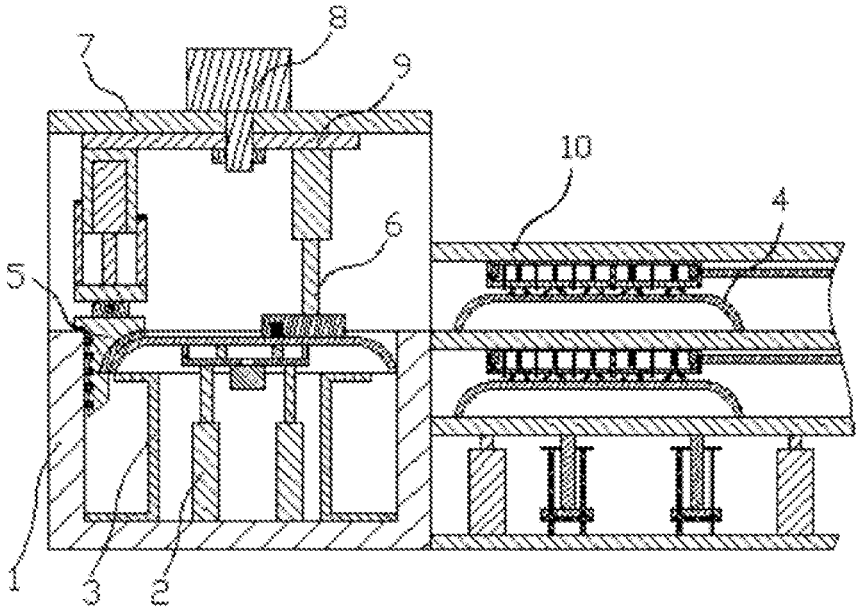
FIG. 1 is a schematic structural diagram of a device for integrally processing a housing of a 3C product.
Figure 2:
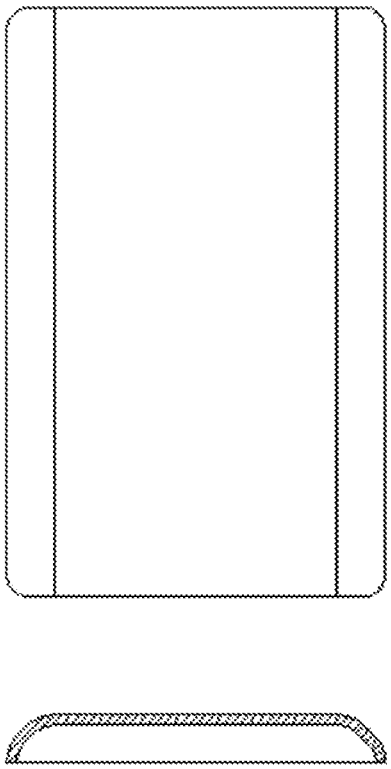
FIG. 2 is a top view and a sectional view of the housing.
Figure 3:
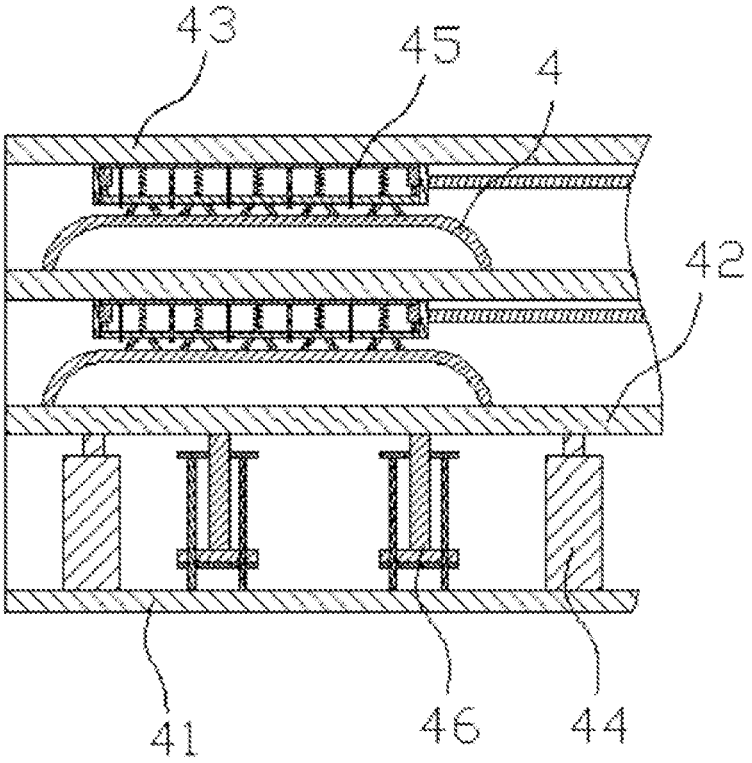
FIG. 3 is a schematic structural diagram of a feeding and discharging device.
Figure 8:
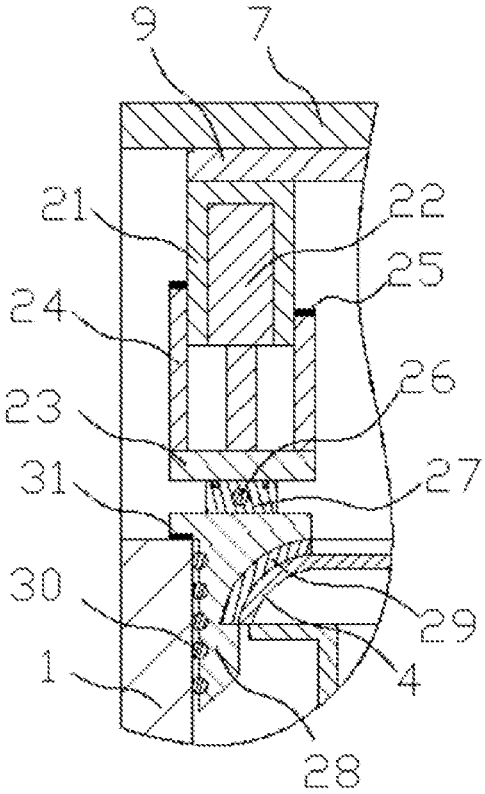
FIG. 8 is a schematic structural diagram of a grinding device.

As shown in FIGS. 1, 3 and 8, the specific structure of the present invention is as follows: a device for integrally processing a housing of a 3C product, where the device includes a loading frame 1 and an upper frame 7, a material receiving device 2 capable of sucking an inner bottom surface of a housing 4 is arranged in the loading frame 1, a width of the loading frame 1 is greater than that of the housing 4, a grinding device 5 is arranged below the upper frame 7, and the grinding device 5 includes a grinding movement device capable of lifting and moving back and forth and arranged below the upper frame 1; the grinding movement device is connected to a grinding installation block 28, an outer side of the grinding installation block 28 is provided with grinding lifting balls 30 tangentially matched with an inner wall of one side of the loading frame 1, a grinding arc block 29 having an identical arc shape of a polished housing is embedded in an inner side of an upper portion of the grinding installation block 28, a distance between an inner side of a lower portion of the grinding installation block and the other side of the loading frame 1 is equal to a width of the housing 4, a lower end of the grinding installation block 28 is an inclined plane inclined outwards and downwards, and the upper frame 1 is also provided with a material pressing device 6 matched with the housing 4. An outer side of the loading frame 1 is provided with a feeding and discharging device 10, the feeding and discharging device includes a lower frame 41, a feeding and discharging lifting cylinder 44 is arranged on the lower frame 41, a discharging barrel 42 and a feeding barrel 43 which are stacked are arranged above the feeding and discharging lifting cylinder 44, and feeding and discharging picking/placing devices 45 are arranged in the discharging barrel 42 and the feeding barrel 43.

The housing 4 is first placed in the feeding barrel 43, and then pushed to the material receiving device 2 through the feeding and discharging picking/placing devices 45. During the placement, it is only necessary to ensure that the housing 4 is positioned in the loading frame 1, then the grinding installation block 28 is driven to descend by the grinding movement device, and the housing 4 is driven to move to the other side through the inclined surface at the lower end of the grinding installation block 28, so that the housing is attached to the other side of the loading frame 1 to complete the positioning of the housing 4; then the housing 4 is pressed by the material pressing device 6, and then the grinding installation block 28 is driven to reciprocate back and forth by the grinding movement device, and slowly descend at the same time. This can further make the grinding arc block 29 finish the grinding of the arc-shaped surface of the housing 4. Through this structure, the grinding device can play the role of assisting in positioning and clamping without initial positioning. After the grinding is finished, the discharging barrel 42 and the feeding barrel 43 are driven to rise by the feeding and discharging lifting cylinder 44, so that the discharging barrel 42 is matched with the loading frame 1, and then the polished housing is taken into the discharging barrel 42 by the feeding and discharging picking/placing device 45, thus completing the integrated operations of feeding, positioning, grinding and discharging, and improving the overall working efficiency.

Figure 4:
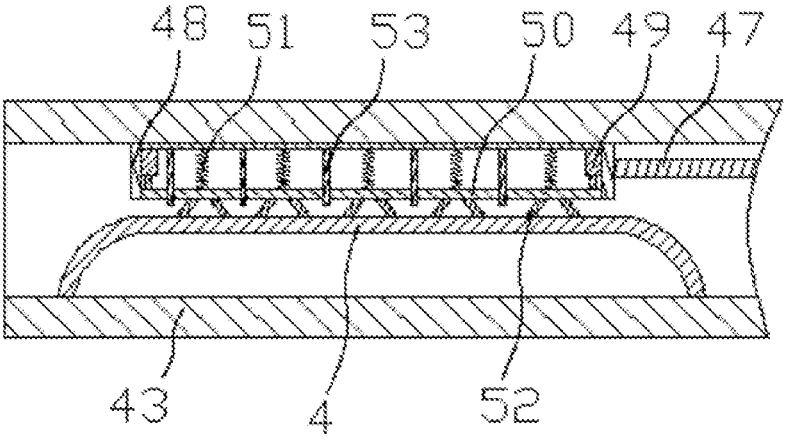
FIG. 4 is a schematic structural diagram of a feeding and discharging picking/placing device.

As shown in FIGS. 3-4, the feeding and discharging picking/placing device 45 includes a feeding and discharging picking/placing movable cylinder 47 which is arranged below the feeding barrel 43 or an upper plate of the discharging barrel 42, and the feeding and discharging picking/placing movable cylinder 47 is connected to a feeding and discharging picking/placing frame 48; a feeding and discharging picking/placing lifting cylinder 49, a feeding and discharging picking/placing spring 51 and an unloading ejector rob 53 are arranged in the feeding and discharging picking/placing frame 48, a feeding and discharging picking/placing lifting block 50 is connected below the feeding and discharging picking/placing lifting cylinder 49, connected to the feeding and discharging picking/placing spring 51 and penetrated by the unloading ejector rob 53, and a feeding and discharging picking/placing suction cup 52 is arranged below the feeding and discharging picking/placing lifting block 50.

The specific operations of the feeding and discharging picking/placing device 45 are as follows. When the housing needs to be sucked, the feeding and discharging picking/placing lifting block 50 is driven to descend by the feeding and discharging picking/placing lifting cylinder 49, so that the feeding and discharging picking/placing suction cup 52 is in contact with and sucks the housing 4, and then the feeding and discharging picking/placing frame 48 is driven to move integrally by the feeding and discharging picking/placing movable cylinder 47; when the feeding and discharging picking/placing frame moves to a proper position and materials need placing, the feeding and discharging picking/placing lifting block 50 is driven to lift by the feeding and discharging picking/placing lifting cylinder 49, so that the housing 4 is in contact with the unloading ejector rob 53, thereby being separated from the feeding and discharging picking/placing suction cup 52. The design of the feeding and discharging picking/placing spring can ensure the smooth lifting of the feeding and discharging picking/placing lifting block 50.

Figure 5:
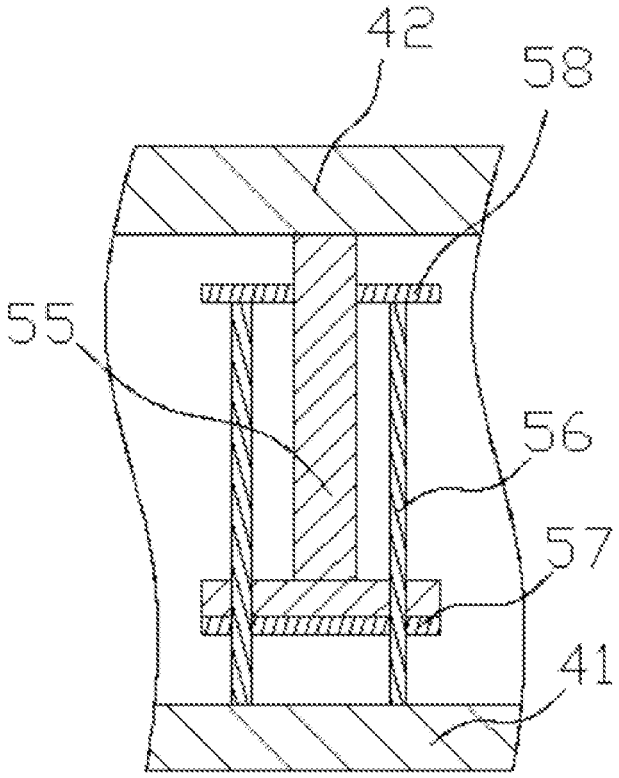
FIG. 5 is a schematic structural diagram of a feeding and discharging lifting limiting device.

As shown in FIG. 5, a feeding and discharging lifting limiting device 46 is arranged between the lower frame 41 and the discharging barrel 42 and includes an inversely T-shaped feeding and discharging limiting movable block 55 arranged below the discharging barrel 42 and a feeding and discharging limiting column 56 arranged on the lower frame 41 in a vertical direction, the feeding and discharging limiting column 56 is provided with a lower limiting plate 57 and an upper limiting plate 58, and when the feeding and discharging limiting movable block 55 is blocked and limited by the lower limiting plate 57 and the upper limiting plate 58, the discharging barrel 42 or the feeding barrel 43 is butted with the loading frame 1.

When the discharging barrel 42 and the feeding barrel 43 are lifted, they are guided and positioned through the feeding and discharging lifting limiting device 46. First in the lifting process, the feeding and discharging limiting column 56 guides the feeding by penetrating the feeding and discharging limiting movable block 55. When the feeding and discharging limiting movable block 55 is in contact with the lower limiting plate 57, the feeding barrel 43 is butted with the loading frame 1. When the feeding and discharging limiting movable block 55 is in contact with the lower limiting plate 57, the discharging barrel 42 is butted with the loading frame 1, thereby ensuring the accurate butt joint of two stations.

As shown in FIG. 8, a plate-shaped structure is arranged on an outer side of the upper portion of the grinding installation block 28 and located above the loading frame 1, and a contact sensor 31 matched with the loading frame 1 is arranged below the plate-shaped structure.

The structural design of the grinding installation block is matched with the contact sensor 31. During grinding, the grinding installation block continuously descends as the grinding proceeds, and a maximum descending range of the grinding installation block can be limited through the design of the contact sensor 31. When this range is reached, the grinding arc block can finish the grinding of the housing only by moving back and forth without further descending.

As shown in FIG. 1, the upper frame 7 is provided with a rotating motor 8, the rotating motor 8 is matched with a turntable 9 below the upper frame 7, the rotating center of the turntable 9 coincides with the center of the loading frame 1, and the grinding device 5 and the material pressing device 6 are arranged below the turntable 9, with a phase difference of 180°.

The design of the turntable enables the grinding device 5 and the material pressing device 6 to rotate by 180° synchronously, thus realizing switched grinding of both sides of the housing and further improving the overall grinding efficiency.

As shown in FIG. 8, the grinding movement device includes a grinding installation barrel 21 arranged below the turntable 9, a grinding lifting cylinder 22 is arranged in the grinding installation barrel 21, a grinding lifting block 23 is connected below the grinding lifting cylinder 22 and provided with a grinding lifting guide block 24 tangentially matched with the grinding installation barrel 21, a grinding movable motor and a grinding movable screw rod 26 which are mutually matched are arranged below the grinding lifting block 23, the grinding movable screw rod 26 is sleeved and matched with the grinding movable block 27, and the grinding installation block 28 is arranged below the grinding movable block 27.

The specific operations of the grinding movement device are as follows. The lifting operation drives the grinding lifting block to move up and down through the grinding lifting cylinder 22; during the lifting, the grinding lifting guide block 24 ensures through dimensional design that there is always a part tangentially matched with the grinding installation barrel 21 to perform a back and forth reciprocating operation; the grinding movable screw rod 26 can be driven to descend by the grinding movable motor, thereby driving the grinding movable block 27 to move, and further driving the grinding installation block and the grinding arc block thereon to move; and the reverse movement of the grinding movable block can be realized through the reverse rotation of the grinding movable motor.

As shown in FIG. 8, there are two grinding lifting guide blocks 24, a difference between heights of the two grinding lifting guide blocks 24 is equal to a thickness of the turntable 9, the higher grinding lifting guide block 24 is positioned outside the turntable 9, and upper ends of the two grinding lifting guide blocks 24 are both provided with pressure sensors 25.

In an initial state, the grinding lifting block 23 can be driven to rise by the grinding lifting cylinder, thereby driving the two grinding lifting guide blocks 24 to rise. Under normal circumstances, the two pressure sensors 25 can synchronously generate induction signals. Specifically, one pressure sensor generates induction signals with the upper frame, and the other generates pressure induction signals with the turntable 9. If the pressure induction signals cannot be synchronously generated, it is proved that the turntable 9 is inclined and needs to be adjusted.

Figure 6:
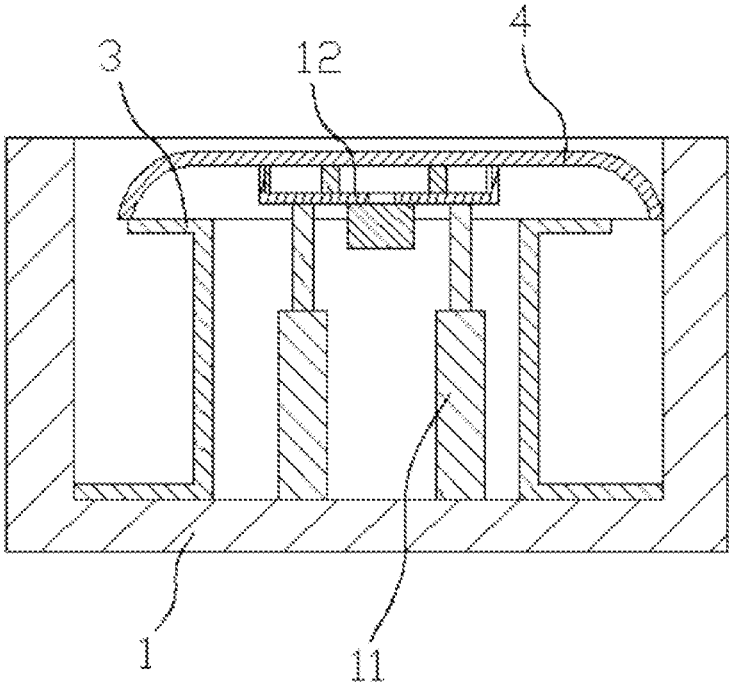
FIG. 6 is a schematic structural diagram of a loading frame and a material receiving device.
Figure 7:
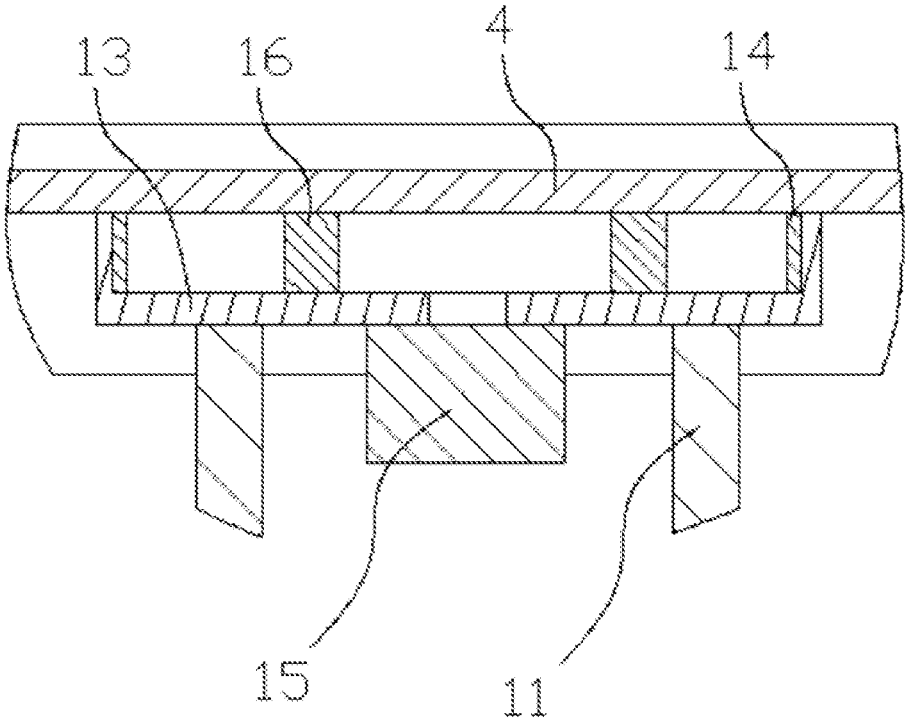
FIG. 7 is a schematic structural diagram of the material receiving device.

As shown in FIG. 6, the material receiving device 2 includes a material receiving lifting cylinder 11 arranged in the loading frame 1, a material receiving block 12 matched with a lower surface of the housing 4 is connected above the material receiving lifting cylinder 11, the material receiving block 12 includes a material receiving frame 13 with an upper opening, a sealing ring 14 capable of being matched with the lower surface of the housing 4 is arranged in the material receiving frame 13, a material receiving supporting column 16 flush with an upper end of the material receiving frame is also arranged in the material receiving frame 13, and a material receiving air pump 15 is communicated below the material receiving frame 13.

During material placing, the material receiving device 2 and the house are in a state where they can move relative to each other. After the position of the housing is adjusted well by the grinding device, the material receiving air pump 15 is used to pump air out, and then the air in the sealing ring 14 is pumped out to form a negative pressure space, so that the housing 4 and the material receiving frame 13 can be fixedly connected through suction. At the same time, the material receiving supporting column 16 can also support the housing 4 to prevent the housing from being crushed by the material pressing device.

As shown in FIG. 6, waste material collecting frames 3 are arranged on both sides inside the loading frame 1, and the waste material collecting frames 3 can support a part of the housing 4 being in a grinding process.

The material collecting frames 3 can collect waste materials and can also support the ground part of the housing 4.

Figure 9:
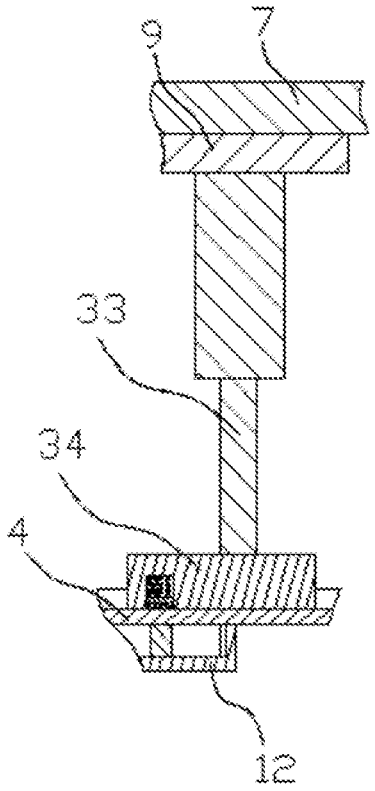
FIG. 9 is a schematic diagram of the matching between a material pressing device and the material receiving device.
Figure 10:
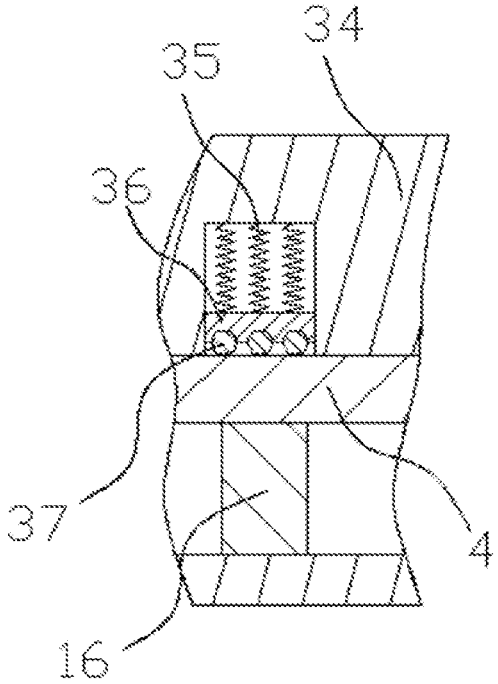
FIG. 10 is a schematic diagram of the matching between a material pressing block and a material receiving supporting column.

As shown in FIGS. 9-10, the material pressing device 6 includes a material pressing lifting cylinder 33 arranged below the upper frame 7, a material pressing block 34 is arranged below the material pressing lifting cylinder 33, a material pressing hole is formed in a lower portion of the material pressing block 34, a material pressing spring 35 in a vertical direction is arranged in the material pressing hole, a material pressing movable block 36 is connected below the material pressing spring 35, and material pressing balls 37 are embedded below the material pressing movable block 36. The position of the material pressing movable block 36 corresponds to the material receiving supporting column 16.

After the housing is placed, the material pressing device drives the material pressing block 34 to descend through the material pressing lifting cylinder 33 but is not in contact with the housing 4. In the initial state and when the material pressing ball 37 exceeds the material pressing block 34, the material pressing ball 37 presses down the housing to a certain extent, such that it can be ensured that the grinding device does not shake when the position of the housing is adjusted. After the position is adjusted, the material pressing spring 35 can be compressed through the continuous lowering of the material pressing block, so that the material pressing block 34 can be pressed against the housing. At the same time, the material pressing movable block 36 can correspond to the position of the material receiving supporting column 16, thus ensuring that the housing at this position is not crushed.

When this patent is specifically used, a control system can be provided to control the cooperative work of each power component, and the overall operation can also be realized through control buttons of each power component.

It should be noted that terms "including", "comprising" or any other variants thereof are intended to cover non-exclusive inclusion, so that a process, method, article or device including a series of elements includes not only those elements but also other elements not explicitly listed, or elements inherent to such a process, method, article, or device.

Specific examples are applied herein to explain the principle and implementation of the present invention. The description of the foregoing examples is only used to help understand the method of the present invention and core ideas thereof. The above description is only the preferred implementation of the present invention. It should be pointed out that since the text expression is limited while there are objectively infinite specific structures, those of ordinary skill in the art can also perform several improvements, embellishments or changes without departing from the principle of the present invention, or can combine the foregoing technical features in appropriate ways. These improvements, embellishments, changes or combinations, or those that directly apply the concepts and technical solutions of the present invention to other occasions without improvement, shall be regarded as falling within the protection scope of the present invention.

What is claimed is:

1. A device for integrally processing a housing of a Computing, Communication, and Consumer (3C) product, comprising a loading frame (1) and an upper frame (7), wherein a material receiving device (2) capable of sucking an inner bottom surface of the housing (4) is arranged in the loading frame (1), a width of the loading frame (1) is greater than that of the housing (4), a grinding device (5) is arranged below the upper frame (7), and the grinding device (5) comprises a grinding movement device capable of lifting and moving back and forth and arranged below the upper frame (1); the grinding movement device is connected to a grinding installation block (28), an outer side of the grinding installation block (28) is provided with grinding lifting balls (30) tangentially matched with an inner wall of one side of the loading frame (1), a grinding arc block (29) having an identical arc shape of a polished housing is embedded in an inner side of an upper portion of the grinding installation block (28), a distance between an inner side of a lower portion of the grinding installation block and another side of the loading frame (1) is equal to a width of the housing (4), a lower end of the grinding installation block (28) is an inclined plane inclined outwards and downwards, and the upper frame (1) is also provided with a material pressing device (6) matched with the housing (4); an outer side of the loading frame (1) is provided with a feeding and discharging device (10), the feeding and discharging device comprises a lower frame (41), a feeding and discharging lifting cylinder (44) is arranged on the lower frame (41), a discharging barrel (42) and a feeding barrel (43) which are stacked are arranged above the feeding and discharging lifting cylinder (44), and feeding and discharging picking/placing devices (45) are arranged in the discharging barrel (42) and the feeding barrel (43).

2. The device for integrally processing the housing of the 3C product according to claim 1, wherein the feeding and discharging picking/placing device (45) comprises a feeding and discharging picking/placing movable cylinder (47) which is arranged below the feeding barrel (43) or an upper plate of the discharging barrel (42), and the feeding and discharging picking/placing movable cylinder (47) is connected to a feeding and discharging picking/placing frame (48); a feeding and discharging picking/placing lifting cylinder (49), a feeding and discharging picking/placing spring (51) and an unloading ejector rob (53) are arranged in the feeding and discharging picking/placing frame (48), a feeding and discharging picking/placing lifting block (50) is connected below the feeding and discharging picking/placing lifting cylinder (49), connected to the feeding and discharging picking/placing spring (51) and penetrated by the unloading ejector rob (53), and a feeding and discharging picking/placing suction cup (52) is arranged below the feeding and discharging picking/placing lifting block (50).

3. The device for integrally processing the housing of the 3C product according to claim 1, wherein a feeding and discharging lifting limiting device (46) is arranged between the lower frame (41) and the discharging barrel (42) and comprises an inversely T-shaped feeding and discharging limiting movable block (55) arranged below the discharging barrel (42) and a feeding and discharging limiting column (56) arranged on the lower frame (41) in a vertical direction, the feeding and discharging limiting column (56) is provided with a lower limiting plate (57) and an upper limiting plate (58), and when the feeding and discharging limiting movable block (55) is blocked and limited by the lower limiting plate (57) and the upper limiting plate (58), the discharging barrel (42) or the feeding barrel (43) is butted with the loading frame (1).

4. The device for integrally processing the housing of the 3C product according to claim 1, wherein a plate-shaped structure is arranged on an outer side of the upper portion of the grinding installation block (28) and located above the loading frame (1), and a contact sensor (31) matched with the loading frame (1) is arranged below the plate-shaped structure.

5. The device for integrally processing the housing of the 3C product according to claim 1, wherein the upper frame (7) is provided with a rotating motor (8), the rotating motor (8) is matched with a turntable (9) below the upper frame (7), a rotating center of the turntable (9) coincides with a center of the loading frame (1), and the grinding device (5) and the material pressing device (6) are arranged below the turntable (9), with a phase difference of 180° C.

6. The device for integrally processing the housing of the 3C product according to claim 5, wherein the grinding movement device comprises a grinding installation barrel (21) arranged below the turntable (9), a grinding lifting cylinder (22) is arranged in the grinding installation barrel (21), a grinding lifting block (23) is connected below the grinding lifting cylinder (22) and provided with a grinding lifting guide block (24) tangentially matched with the grinding installation barrel (21), a grinding movable motor and a grinding movable screw rod (26) which are mutually matched are arranged below the grinding lifting block (23), the grinding movable screw rod (26) is sleeved and matched with the grinding movable block (27), and the grinding installation block (28) is arranged below the grinding movable block (27).

7. The device for integrally processing the housing of the 3C product according to claim 6, wherein there are two grinding lifting guide blocks (24), a difference between heights of the two grinding lifting guide blocks (24) is equal to a thickness of the turntable (9), the higher grinding lifting guide block (24) is positioned outside the turntable (9), and upper ends of the two grinding lifting guide blocks (24) are both provided with pressure sensors (25).

8. The device for integrally processing the housing of the 3C product according to claim 1, wherein the material receiving device (2) comprises a material receiving lifting cylinder (11) arranged in the loading frame (1), a material receiving block (12) matched with a lower surface of the housing (4) is connected above the material receiving lifting cylinder (11), the material receiving block (12) comprises a material receiving frame (13) with an upper opening, a sealing ring (14) capable of being matched with the lower surface of the housing (4) is arranged in the material receiving frame (13), a material receiving supporting column (16) flush with an upper end of the material receiving frame is also arranged in the material receiving frame (13), and a material receiving air pump (15) is communicated below the material receiving frame (13).

9. The device for integrally processing the housing of the 3C product according to claim 8, wherein the material pressing device (6) comprises a material pressing lifting cylinder (33) arranged below the upper frame (7), a material pressing block (34) is arranged below the material pressing lifting cylinder (33), a material pressing hole is formed in a lower portion of the material pressing block (34), a material pressing spring (35) in a vertical direction is arranged in the material pressing hole, a material pressing movable block (36) is connected below the material pressing spring (35), and material pressing balls (37) are embedded below the material pressing movable block (36).

10. The device for integrally processing the housing of the 3C product according to claim 1, wherein waste material collecting frames (3) are arranged on both sides inside the loading frame (1), and the waste material collecting frames (3) can support a part of the housing (4) being in a grinding process.

* * * * *